United States Patent [19]

Boyle

[11] Patent Number: 4,482,055

[45] Date of Patent: Nov. 13, 1984

[54] INTEGRAL CARTON BLANK FOR A CARTON WITH FOUR CELLS AND CARTON

[75] Inventor: Daniel J. Boyle, Hartland, Wis.

[73] Assignee: Champion International Corporation, Stamford, Conn.

[21] Appl. No.: 345,610

[22] Filed: Feb. 4, 1982

Related U.S. Application Data

[63] Continuation of Ser. No. 196,842, Oct. 14, 1980, abandoned.

[51] Int. Cl.[3] ..... B65D 5/48; B65D 5/54

[52] U.S. Cl. ..... 206/606; 229/27; 229/28 R; 229/41 B

[58] Field of Search ..... 229/28 R, 27, 28 BC, 229/15, 41 R, 41 B, 41 D; 206/606, 608, 174, 175, 623, 227, 604, 190, 170, 446, 561, 593

[56] References Cited

U.S. PATENT DOCUMENTS

| | | | |
|---|---|---|---|
| 1,178,675 | 4/1916 | Potter | 229/28 R |
| 2,150,461 | 3/1939 | Sandell | 229/41 B X |
| 2,611,529 | 9/1952 | Curriuan | 229/41 B X |
| 2,755,965 | 7/1956 | Ringler | 206/190 |
| 2,759,654 | 8/1956 | Lugt, Jr. | 229/41 B X |
| 2,828,902 | 4/1958 | Ringler | 229/41 B |
| 3,135,453 | 6/1964 | Struble | 229/27 |
| 3,184,142 | 5/1965 | Rosenburg | 229/28 R |
| 3,291,372 | 12/1966 | Saidel | 206/623 |
| 3,326,444 | 6/1967 | Farquhar et al. | 229/27 |

*Primary Examiner*—William Price
*Assistant Examiner*—Gary E. Elkins
*Attorney, Agent, or Firm*—Evelyn M. Sommer; William W. Jones

[57] ABSTRACT

A one-piece paperboard carton blank comprises a tandem series of four consecutively articulated rectangular panels forming the four sides of the erected carton; flaps connected by fold lines to respective side panels to form the bottom of the carton; flaps connected to respective side panels by fold lines to form the top of the carton; and a tandem series of cell panels which are folded and glued to form integral partitions (dividers) within the erected carton. The cell panels preferably consist of seven panels, two of which have tongue portions which lie in parallel and separated planes in the erected carton and two of which have glue stripes (glue lines) on their faces. The glued carton may lie flat for shipment and storage and is readily erected to form an integral carton having internal cells (compartments).

9 Claims, 5 Drawing Figures

INTEGRAL CARTON BLANK FOR A CARTON WITH FOUR CELLS AND CARTON

This is a continuation of application Ser. No. 196,842, filed Oct. 14, 1980 and now abandoned.

BACKGROUND OF THE INVENTION

The present invention relates to paperboard cartons and carton blanks and more particularly to such cartons having internal cells formed by separation (dividing) means to protect articles packed in the carton.

It is often desirable to package items in paperboard cartons so that the packaged items are supported within the carton. For example, if the item is relatively costly and breakable, it may be wrapped with paper, plastic, rigid or flexible plastic foam, plastic bubble material or corrugated cardboard before it is packaged in the carton.

For items which are intended to be mass-distributed, particularly those items which are not rectangular in shape, a carton may have internal dividing (separation) means, such as walls, to form "cells", i.e., dividing the carton into areas. For example, a square carton may have two paperboard internal separation walls, at right angles, dividing the carton into four cells. Each separator divider would have a slot so that they may be interfitted.

However, the use of separate internal dividing walls may be relatively costly in material and labor. In addition, if the dividing walls are added to the carton after it is erected ("squared up"), for example, by gluing them to the carton, then the entire carton assembly (including the dividing walls in place) cannot be shipped or stored in a flat state. If the partition walls are not glued to the carton walls, but are made so they fold upon each other when the carton is flat, they may be unstable within the carton.

OBJECTIVES AND FEATURES OF THE INVENTION

It is an objective of the present invention to provide a one-piece paperboard carton blank, and the carton erected from that blank, in which the erected carton is divided into four cells by internal dividing means which are integral with the carton, which are stable within the carton, and which will protect articles packed within the carton.

It is a further objective of the present invention to provide a one-piece paperboard carton blank, and the carton erected from the blank, in which the carton, including its internal dividing means, may be shipped and stored in a flat state after it has been glued and before it has been erected.

It is a further objective of the present invention to provide a one-piece paperboard carton blank, and the carton erected from that blank, in which the carton blank may be produced in an economical manner using conventional carton blank manufacturing technology and equipment.

It is a still further objective of the present invention to provide a one-piece paperboard carton blank, and the carton erected from that blank, in which the carton may be readily erected with its internal dividing means in their desired position, without the necessity of inserting additional material to use as the dividing walls.

It is a feature of the present invention to provide a one-piece paperboard carton blank adapted to be erected into a carton, and the carton erected from that blank. The carton has integral internal dividing means which make it into a multi-cell carton.

The carton blank comprises a series of four side panels which are connected by fold lines and aligned in tandem along a common axis. The side panels are adapted to form the four side walls of the carton. The carton blank also comprises a plurality of bottom flaps, with each bottom flap being connected by a fold line to one of the side panels, the bottom flaps being adapted to form the bottom of the carton; and a plurality of top flaps, with each top flap being connected by a fold line to one of the side panels, the top flaps being adapted to form the top of the carton.

The carton blank further comprises a plurality of cell panels adapted to form the dividing means of the carton. The cell panels are connected in tandem by fold lines along an axis. The cell panels comprise a first cell panel having an extending tongue portion; a second cell panel having an indentation in which the tongue portion of the first panel is located; a third cell panel; a fourth cell panel having glue means on its underside face; a fifth cell panel having an extending tongue portion; a sixth panel having an indentation in which the tongue portion of the fifth panel is located; and a seventh panel having glue means on its underside face.

In the glued and erected carton the fourth and seventh cell panels are glued to side panels, which side panels are perpendicular to each other, and the first and fifth cell panels are positioned in parallel planes.

It is a further feature of the present invention to provide such a carton blank which comprises a glue panel connected by fold lines to the fourth side panels and the first cell panel and having glue means on its upper side face.

BRIEF DESCRIPTION OF THE DRAWINGS

Other objectives and features of the present invention will be apparent from the following detailed description of the invention, taken in conjunction with the accompanying drawings, which describe a preferred embodiment of the invention.

In the drawings.

DETAILED DESCRIPTION OF THE INVENTION

The present invention is of a paperboard carton blank, for example, constructed of coated cardboard, and the carton which is glued and erected from that blank.

Figure 1:
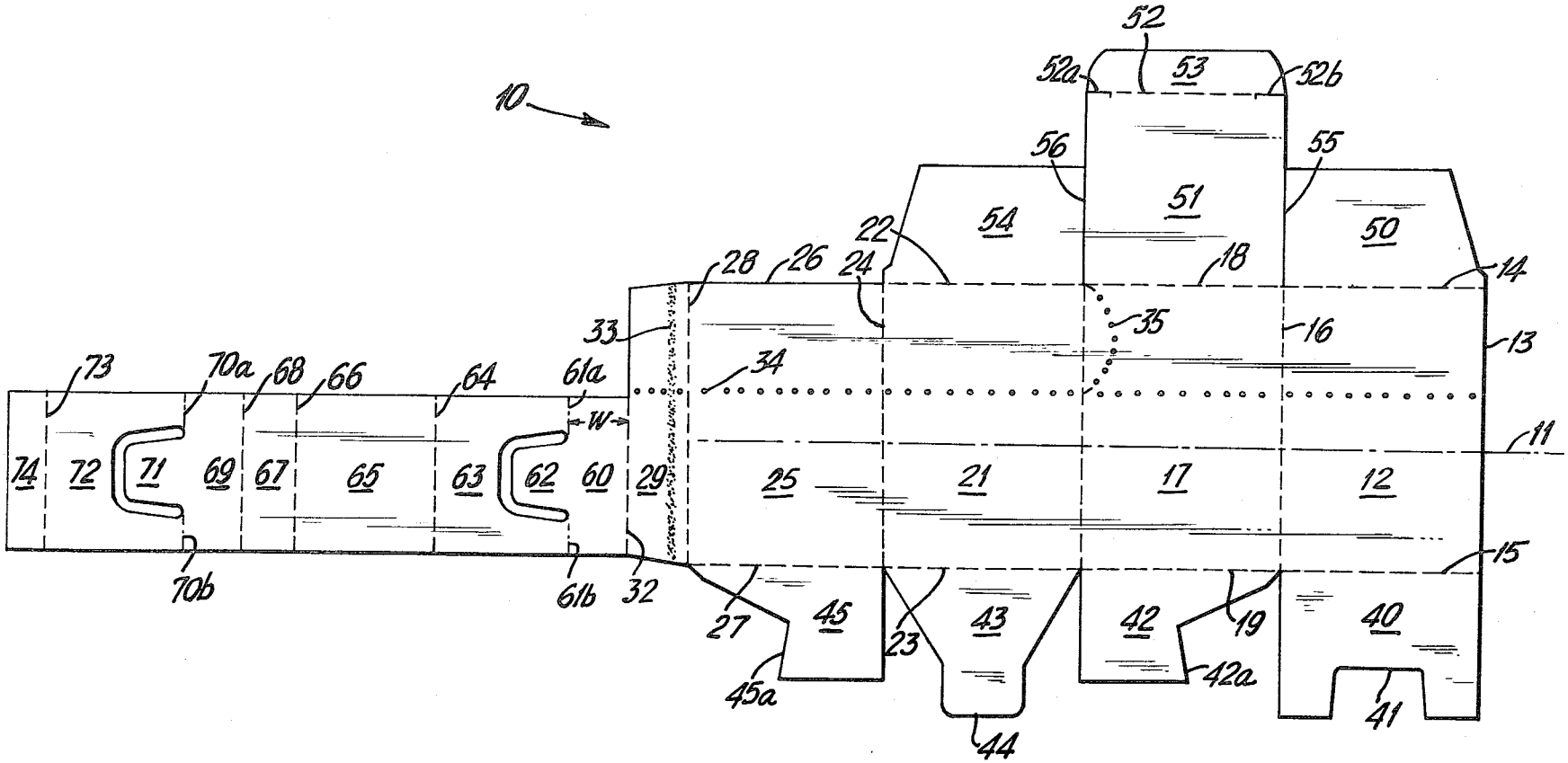
FIG. 1 is a top plan view of the carton blank of the present invention.

In FIG. 1 the blank is shown as a one-piece unitary paperboard carton blank which may be manufactured using conventional technology and machines. For example, it may be die-cut from coated cardboard in a single-press run. In FIG. 1 the fold lines are shown by dash-dash lines; the score lines, i.e., the break-away lines, are shown by dotted lines; the imaginary axis of the blank is shown by a dash-dot line; the cut lines, i.e., separation lines, are shown by solid lines; and the glue stripes, i.e., glue areas, are shown by stippled areas.

As shown in FIG. 1, the carton blank 10 comprises a series of consecutively articulatable panels arranged in tandem along an imaginary axis 11. The panels include four side panels which form the four sides of the erected carton. The first side panel 12 has an outer free edge 13; opposite and parallel fold lines 14 and 15; and a fold line 16, parallel to the free edge 13, which connects the first side panel 12 to the second side panel 17. The second side panel 17 has parallel and opposite fold lines 18,19, perpendicular to its fold line 16, and a fold line 20, parallel to the fold line 16, which connects the second side panel 17 to the third side panel 21.

Similarly, the third side panel 21 has opposite and parallel fold lines 22,23 and a fold line 24 perpendicular to the fold lines 22,23 and parallel to the fold line 20. The fold line 24 connects the third side panel 21 to the fourth side panel 25. The fourth side panel has a fold line 27 perpendicular to the fold line 24, a fold line 28 perpendicular to the fold line 27, and a free edge 26 which is parallel to the fold line 27. The four side panels 12, 17, 21 and 25 are preferably right-angled rectangular panels. The side panels 12, 17, 21 and 25 are arranged in tandem along the imaginary axis 11.

A series of top flaps are connected by fold lines to certain of the side panels and they are adapted to form the top of the erected carton. The first top flap 50 is connected by the fold line 14 to the first side panel 12. A cut line 55 separates the first top flap 50 from the second top flap 51, which is connected by the fold line 18 to the second side panel 17. A tuck flap 53 is connected by the fold line 52 to the second top flap 51. The short cut lines 52*a* and 52*b* are used at the opposite ends of the fold line 52 to aid in retaining the tuck flap within the erected carton. A cut line 56 separates the second top flap 51 from the third top flap 54, with the third top flap being connected to the third side panel 21 by the fold line 22.

A series of bottom flaps are connected to the side panels and are adapted to interconnect with each other, upon erection of the carton, to form the bottom of the carton. The bottom flaps comprise the first bottom flap 40, which is connected to the first side panel 12 by the fold line 15; the second bottom flap 42, which is connected to the second side panel 17 by the fold line 19; the third bottom flap 43, which is connected to the third side panel 21 by the fold line 23; and the fourth bottom flap 45, which is connected to the fourth side panel 25 by the fold line 27.

A glue flap 29, which is connected to the fourth side panel 25 by the fold line 28, is used to fasten the sides of the carton together. The glue panel 29 has a glue stripe 33 which is parallel to the fold line 28.

A score line 34 enables the user to readily remove the top portion of the carton after it has been erected, filled with contents, and sold to the user. The score line 34 runs across the entire width of the side panels 12, 17, 21 and 25 and the glue panel 29. The score line 34 is parallel to the bottom fold lines 15, 19, 23 and 27 and to the top fold lines 14, 18, 22 and 26. In addition, a crescent-shaped score line 35 is directed inwardly at the upper left corner of the second side panel 17, as shown in FIG. 1. The crescent-shaped score line 35 forms a crescent-shaped tab which may be opened by the user and used to break the score line 34.

A series of cell panels, which are connected in tandem along the axis 11 and are a unitary portion of the one-piece paperboard blank, are used as the dividing means of the erected carton. These cell panels, by their arrangement and positioning, divide the erected carton into the desired number of cells.

The cell panels comprise a first cell panel 60 having an integral extended tongue portion 62. The first cell panel 60 is connected to the second cell panel 63 by the short upper fold line 61*a* and the short bottom fold line 61*b*. The tongue portion 62 of the first cell panel extends into the second cell panel 63.

The second cell panel 63 is connected to the third cell panel by the fold line 64 and the third cell panel 65 is connected to the fourth cell panel 67 by the fold line 66. The fifth cell panel 69, which is connected to the fourth cell panel 67 by the fold line 68, is connected to the sixth cell panel by the short upper fold line 70*a* and the short lower fold line 70*b*. The fifth cell panel 69 is similar to the first cell panel in having an integral extended tongue portion 71. The sixth cell panel 72 has an indentation in which is located the tongue portion 71 of the fifth cell panel 69. The sixth cell panel 72 is connected to the seventh cell panel 74 by the fold line 73.

Glue areas are provided on certain of the cell panels so that the may be adhered to the inner faces of certain of the side panels. The underside face (the side opposite from the side illustrated in FIG. 1) of the fourth cell panel 67 has a glue stripe parallel to the fold line 66. Similarly, a glue stripe is provided on the underside face of the seventh cell panel 74.

The carton is preferably glued, including the adhesion of the cell panels to the inner faces of certain of the side panels, before the carton is erected. The glued but unerected carton may be shipped and stored in a flat state. For that purpose, the glue stripe 33 on the upper face of the glue panel 29 is adhered to the underface of the first side panel 12, with the fold line 28 aligned with the free edge 13. The glue area on the fourth cell panel 67 is adhered to the third side panel 21. Preferably the adhesion is made so that fold line 66 is parallel to the fold line 20 and separated from it by a short distance. The glue area on the face of the seventh cell panel 74 is adhered to the underside face of the fourth side panel 25. The adhesion is made so that the fold line 73 is parallel to the fold line 24 and separated from it by a distance which is the width W of the fifth panel 69 (the width between the fold line 68 and the fold line 70*a*).

Figure 2:
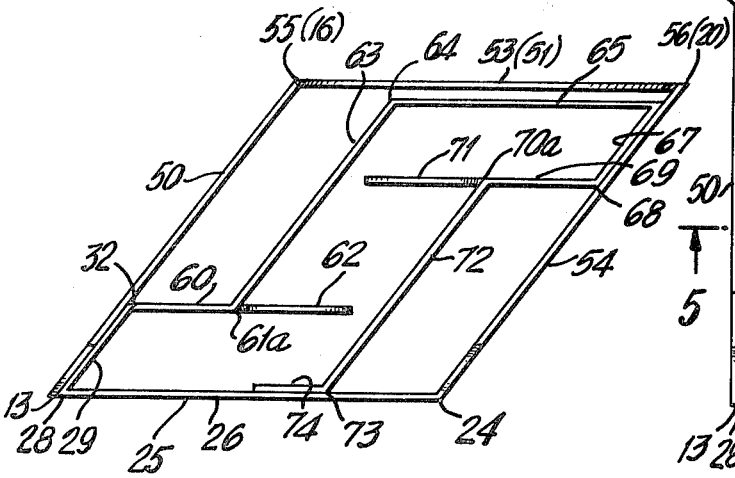
FIG. 2 is a top plan view of the glued carton of the present invention before it is fully erected.
Figure 3:
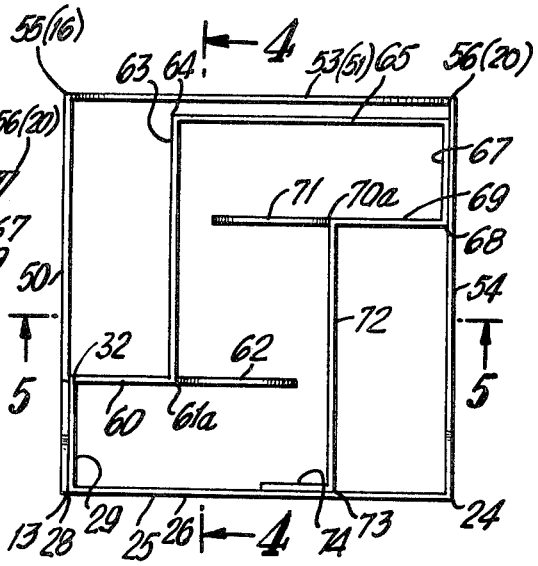
FIG. 3 is a top plan view similar to that of FIG. 2 but with the carton fully erected.
Figure 4:
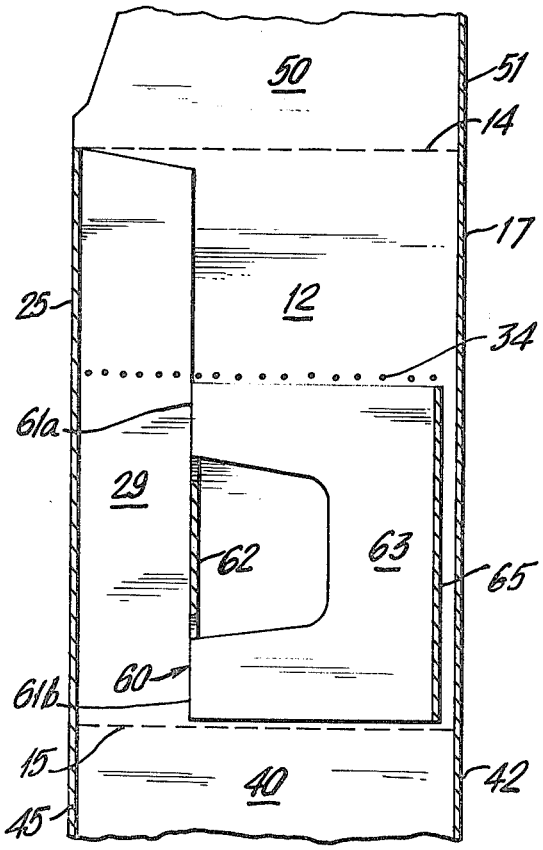
FIG. 4 is a cross-sectional view taken along the lines 4—4 of FIG. 3.
Figure 5:
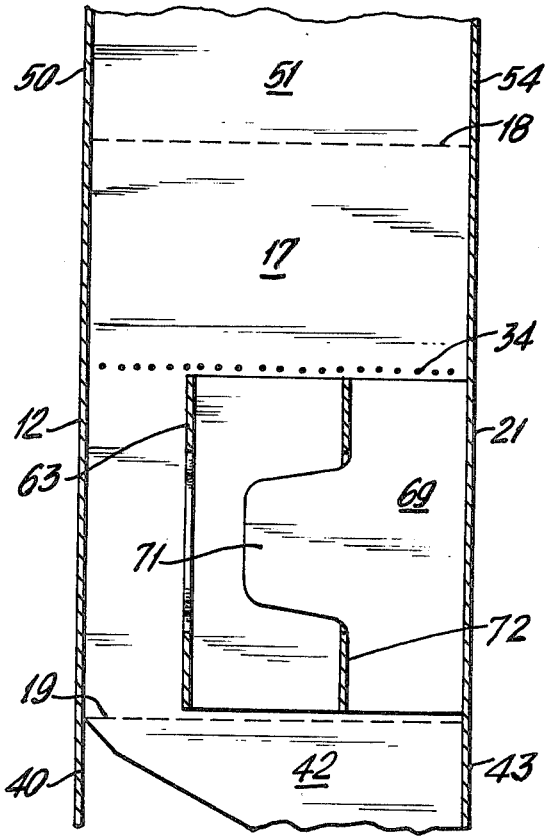
FIG. 5 is a cross-sectional view taken along lines 5—5 of FIG. 3.

In erecting the carton, pressure is applied so that it is first partially opened, as shown in FIG. 2, and then fully opened, as shown in FIG. 3, which may be in a rapid movement. For example, pressure may be applied, to open the carton, by pressing inwardly on the fold lines 28 and 20. When the carton is fully opened, the first tongue portion 62 and its first cell panel 60 lie in a plane which is parallel to, and spaced from, the plane in which lie the fifth cell panel 69 and its tongue 71. Similarly, the second cell panel 63 lies in a plane which is parallel to, and spaced from, the plane in which lies the sixth cell panel 72.

To complete the erection of the carton, the bottom flaps are interconnected by first inwardly folding the second bottom flap and the fourth bottom flap so that their ends overlie, folding inwardly the first bottom flap and inserting the outer free end 44 of the fourth bottom flap in the small gap which is formed by the left bottom edge 41 of the first bottom flap, and the folded-over ends 42*a* and 45*a* of the second and fourth bottom flaps, respectively. The top is closed by folding inwardly the first top flap 50 and the third top flap 54, and then folding inwardly, and above them, the second top flap 51. Finally, the tuck flap 53 is pressed downwardly so that it lies against the inner face of the fourth side panel 25.

It is thus seen that the present invention provides a carton which is formed from a one-piece paperboard blank, for example, of coated cardboard, and which may be glued and erected using conventional machinery and techniques. The carton has an integral internal dividing means forming it into a multi-cell carton, without the necessity of inserting a separate dividing means.

Modifications may be made in the preferred embodiment described above which are within the scope of the present invention. For example, the carton may be manufactured without the score line 34; it may be manufactured with a different number and construction for its bottom flaps; and it may be manufactured with a different number and construction for its top flaps.

What is claimed is:

1. A one-piece paperboard carton blank adapted to be erected into a carton, the carton having integral internal dividing means forming a multi-cell carton, said carton blank comprising:

a series of four side panels connected by fold lines, aligned in tandem along a common axis and adapted to form the four side walls of the carton;

a plurality of bottom flaps, each bottom flap being connected by a fold line to one of said side panels, said bottom flaps being adapted to form the bottom of the carton; and a plurality of cell panels adapted to form the dividing means of the carton, said cell panels being connected in tandem by fold lines along said axis, said cell panels comprising a first cell panel having an extending tongue portion; a second cell panel having an indentation in which the tongue portion of the first panel is located; a third cell panel; a fourth cell panel having glue means thereon; a fifth cell panel having an extending tongue portion; a sixth cell panel having an indentation in which the tongue portion of the fifth cell panel is located; and a seventh cell panel having glue means thereon.

2. A carton blank as in claim 1 and further comprising a glue panel connected by fold lines to the fourth side panel and the first cell panel and having glue means thereon.

3. The carton blank of claim 1, further comprising a plurality of top flaps, each top flap being connected by a fold line to one of said side panels, said top flaps being adapted to form a top of the carton.

4. A carton blank as in claim 3 wherein each of said side panels is a right-angled rectangular panel having a score line perpendicular to the fold lines connecting it to the other side panels; said score lines forming a continuous score line around the erected carton to permit the top of the carton, above the score line, to be readily removed.

5. A carton as in claim 1 wherein said first and fifth cell panels are the same in size and shape and said second and sixth cell panels are the same in size and shape.

6. A one-piece paperboard erected multi-cell carton having integral internal dividing means, said carton comprising:

a series of four side panels connected by fold lines forming the four side walls of the carton;

a plurality of bottom flaps, each bottom flap being connected by a fold line to one of said side panels and folded to be perpendicular thereto, said bottom flaps forming the bottom of the carton;

a glue panel connected by fold lines to the fourth side panel and having glue means connecting it to the inside face of the first side panel; and a plurality of cell panels forming the dividing means of the carton, said cell panels being connected in tandem by fold lines, said cell panels comprising a first cell panel having an extending tongue portion, said first cell panel being connected by a fold line of the glue panel and perpendicular thereto; a second cell panel perpendicular to said first cell panel and having an indentation from which the tongue portion of the first cell panel is taken; a third cell panel perpendicular to the second cell panel; a fourth cell panel having glue means thereon attaching it to the inside face of said third panel; a fifth cell panel perpendicular to the fourth cell panel and having an extending tongue portion; a sixth cell panel perpendicular to the fifth cell panel and having an indentation from which the tongue portion of the fifth cell panel is taken; and a seventh cell panel having glue means attaching it to the inside face of the fourth side panel; wherein said first and fifth cell panels lie in parallel and separated planes and said second and sixth cell panels lie in separated and parallel planes.

7. A carton as in claim 6 wherein each of said side panels is a right-angled rectangular panel.

8. A carton as in claim 6 wherein a score line runs continuously across said side panels to enable the top portion of the carton to be readily separated.

9. A carton as in claim 6 wherein said first and fifth cell panels are the same in size and shape and said second and sixth cell panels are the same in size and shape.

* * * * *

UNITED STATES PATENT AND TRADEMARK OFFICE

CERTIFICATE OF CORRECTION

PATENT NO. : 4,482,055

DATED : November 13, 1984

INVENTOR(S) : Daniel J. Boyle

It is certified that error appears in the above—identified patent and that said Letters Patent is hereby corrected as shown below:

In column 4, line 24, delete "the", first occurrence and insert -- they --.

In Column 6, line 26, delete "of" and insert in lieu thereof -- to --.

In Column 6, line 32, delete "third panel" and insert in lieu thereof -- third side panel --.

Signed and Sealed this

Seventh Day of May 1985

[SEAL]

*Attest:*

DONALD J. QUIGG

*Attesting Officer* *Acting Commissioner of Patents and Trademarks*